US009008546B2

(12) United States Patent
Taguchi et al.

(10) Patent No.: US 9,008,546 B2
(45) Date of Patent: Apr. 14, 2015

(54) IMAGE CARRIER, PROCESS CARTRIDGE, AND IMAGE FORMING APPARATUS

(71) Applicants: Nobuyuki Taguchi, Kanagawa (JP); Satoshi Hatori, Kanagawa (JP); Naohiro Kumagai, Kanagawa (JP); Kaoru Yoshino, Tokyo (JP); Hiromichi Ninomiya, Kanagawa (JP); Yuta Azeyanagi, Kanagawa (JP); Yasuhito Kuboshima, Tokyo (JP); Hideyasu Seki, Chiba (JP); Ryohta Gotoh, Tokyo (JP)

(72) Inventors: Nobuyuki Taguchi, Kanagawa (JP); Satoshi Hatori, Kanagawa (JP); Naohiro Kumagai, Kanagawa (JP); Kaoru Yoshino, Tokyo (JP); Hiromichi Ninomiya, Kanagawa (JP); Yuta Azeyanagi, Kanagawa (JP); Yasuhito Kuboshima, Tokyo (JP); Hideyasu Seki, Chiba (JP); Ryohta Gotoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/073,971

(22) Filed: Nov. 7, 2013

(65) Prior Publication Data

US 2014/0147170 A1 May 29, 2014

(30) Foreign Application Priority Data

Nov. 27, 2012 (JP) ..... 2012-258213

(51) Int. Cl.
*G03G 15/00* (2006.01)

(52) U.S. Cl.
CPC ..... *G03G 15/751* (2013.01)

(58) Field of Classification Search
USPC ..... 399/117
See application file for complete search history.

(56) References Cited

U.S. PATENT DOCUMENTS

| | | | | |
|---|---|---|---|---|
| 5,151,737 | A * | 9/1992 | Johnson et al. | 399/117 |
| 6,615,722 | B2 * | 9/2003 | Alberstadt et al. | 101/375 |
| 2002/0057924 | A1 * | 5/2002 | Ueno et al. | 399/117 |
| 2004/0258432 | A1 | 12/2004 | Hatori et al. | |
| 2006/0045603 | A1 | 3/2006 | Hatori et al. | |
| 2006/0110184 | A1 | 5/2006 | Yoshino et al. | |
| 2006/0193655 | A1 | 8/2006 | Hatori et al. | |
| 2007/0059035 | A1 | 3/2007 | Yoshino et al. | |
| 2014/0126930 | A1 * | 5/2014 | Kashiide et al. | 399/111 |

FOREIGN PATENT DOCUMENTS

JP 2009-063967 3/2009

* cited by examiner

*Primary Examiner* — W B Perkey
(74) *Attorney, Agent, or Firm* — Harness, Dickey & Pierce

(57) ABSTRACT

An image carrier includes a tubular image carrier body to carry an image on an outer circumferential surface thereof, a shaft disposed inside the image carrier body, a first flange mounted on the shaft, and a second flange spaced apart from the first flange in an axial direction of the image carrier and mounted on the shaft. Each of the first flange and the second flange includes a through-hole contacting the shaft, a first engagement portion to engage a lateral end of the image carrier body in the axial direction of the image carrier, and a second engagement portion, constituting at least a part of the through-hole, to engage the shaft. The second engagement portion is disposed inboard from the first engagement portion in the axial direction of the image carrier.

19 Claims, 5 Drawing Sheets

IMAGE CARRIER, PROCESS CARTRIDGE, AND IMAGE FORMING APPARATUS

CROSS-REFERENCE TO RELATED APPLICATION

This patent application is based on and claims priority pursuant to 35 U.S.C. §119 to Japanese Patent Application No. 2012-258213, filed on Nov. 27, 2012, in the Japanese Patent Office, the entire disclosure of which is hereby incorporated by reference herein.

BACKGROUND

1. Technical Field

Example embodiments generally relate to an image carrier, a process cartridge, and an image forming apparatus, and more particularly, to an image carrier for carrying an image and a process cartridge and an image forming apparatus incorporating the image carrier.

2. Background Art

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such photoconductor may be a photoconductive drum incorporating a shaft penetrating the photoconductive drum to enhance the mechanical strength of the photoconductive drum.

For example, JP-2009-063967-A discloses a flange inserted by press fit into the tubular photoconductive drum at each lateral end of the photoconductive drum in an axial direction thereof. The shaft is inserted into a through-hole produced in each flange. Thus, the photoconductive drum incorporating the shaft achieves an enhanced mechanical strength against bending and deformation.

However, an abutment member contacting the photoconductive drum may exert an increased force to the photoconductive drum or an increased number of abutment members may contact the photoconductive drum. Further, the photoconductive drum may have a decreased outer diameter or an increased length in the axial direction thereof. Accordingly, the photoconductive drum is susceptible to bending and deformation.

SUMMARY

At least one embodiment provides a novel image carrier that includes a tubular image carrier body to carry an image on an outer circumferential surface thereof, a shaft disposed inside the image carrier body, a first flange mounted on the shaft, and a second flange spaced apart from the first flange in an axial direction of the image carrier and mounted on the shaft. Each of the first flange and the second flange includes a through-hole contacting the shaft, a first engagement portion to engage a lateral end of the image carrier body in the axial direction of the image carrier, and a second engagement portion, constituting at least a part of the through-hole, to engage the shaft. The second engagement portion is disposed inboard from the first engagement portion in the axial direction of the image carrier.

At least one embodiment provides a novel process cartridge, detachably attachable to an image forming apparatus, that includes the image carrier described above.

At least one embodiment provides a novel image forming apparatus that includes the image carrier described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
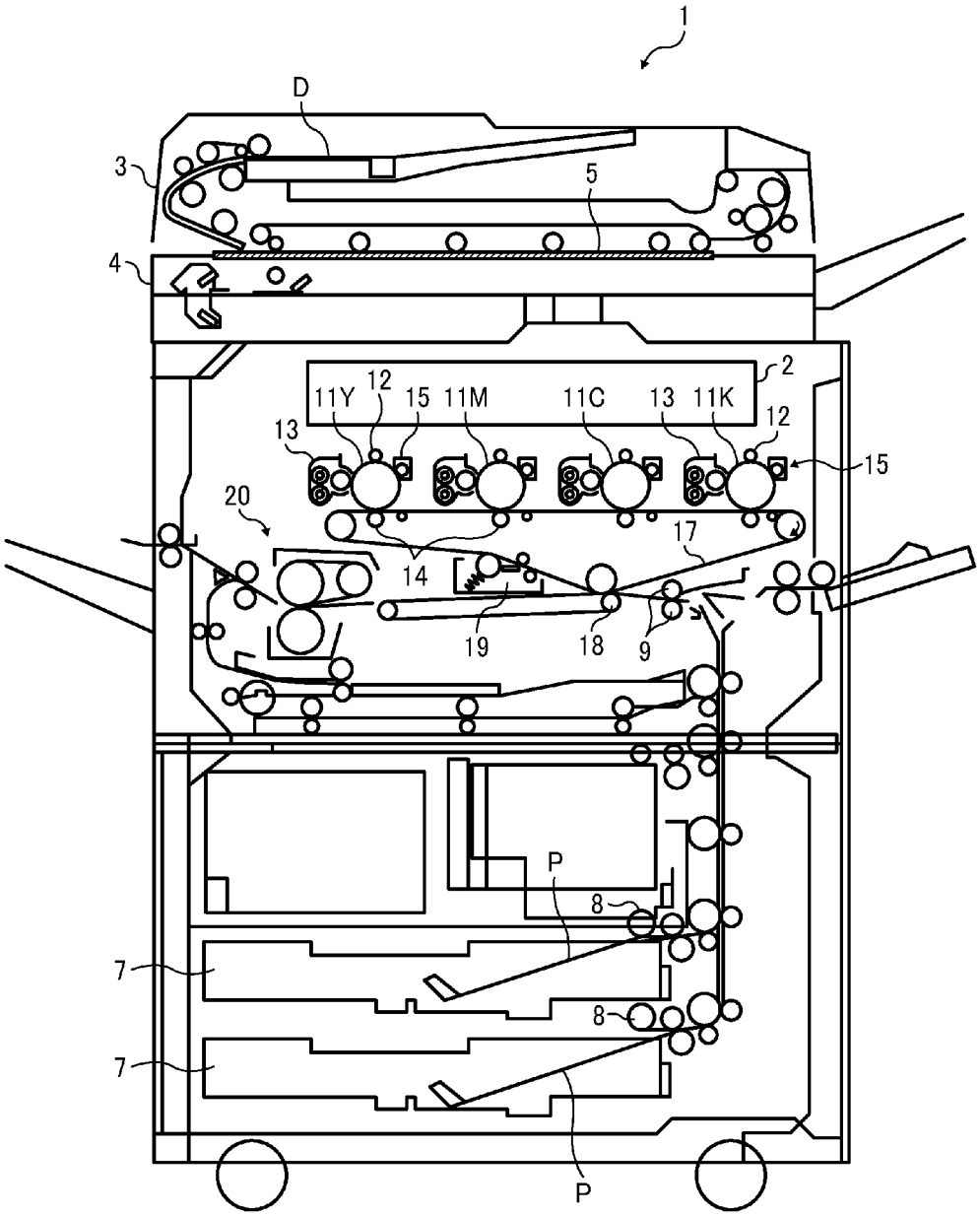
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this example embodiment, the image forming apparatus 1 is a tandem color copier that forms color and monochrome toner images on recording media by electrophotography.

An auto document feeder (ADF) 3 disposed atop the image forming apparatus 1 feeds an original D to a reader 4 situated below the ADF 3. The reader 4 reads an image on the original D into image data. A writer 2 disposed below the reader 4 emits laser beams onto four photoconductive drums 11Y, 11M, 11C, and 11K according to the image data sent from the reader 4, thus forming electrostatic latent images on the photoconductive drums 11Y, 11M, 11C, and 11K, respectively. Four process cartridges 15 serving as detachable units detachably attached to the image forming apparatus 1 and accommodating the photoconductive drums 11Y, 11M, 11C, and 11K visualize the electrostatic latent images into yellow, magenta, cyan, and black toner images, respectively. For example, each process cartridge 15 includes a charging roller 12 serving as a charger that charges the respective photoconductive drums 11Y, 11M, 11C, and 11K, a development device 13 that develops the electrostatic latent image formed on the respective photoconductive drums 11Y, 11M, 11C, and 11K into a toner image. Thus, the photoconductive drums 11Y, 11M, 11C, and 11K serve as image carriers that bear the electrostatic latent images and the resultant yellow, magenta, cyan, and black toner images, respectively. Four primary transfer bias rollers 14 disposed opposite the four photoconductive drums 11Y, 11M, 11C, and 11K, respectively, primarily transfer the yellow, magenta, cyan, and black toner images formed on the photoconductive drums 11Y, 11M, 11C, and 11K onto an intermediate transfer belt 17 such that the yellow, magenta, cyan, and black toner images are superimposed on a same position on the intermediate transfer belt 17, thus forming a color toner image thereon. A plurality of paper trays 7 situated in a lower portion of the image forming apparatus 1 loads a plurality of recording media P (e.g., transfer sheets). A feed roller 8 rotatably mounted on the respective paper trays 7 feeds a recording medium P toward a registration roller pair 9 (e.g., a timing roller pair).

As the registration roller pair 9 feeds the recording medium P to a secondary transfer bias roller 18 disposed opposite the intermediate transfer belt 17, the secondary transfer bias roller 18 secondarily transfers the color toner image formed on the intermediate transfer belt 17 onto the recording medium P. An intermediate transfer belt cleaner 19 disposed opposite the intermediate transfer belt 17 cleans the intermediate transfer belt 17. A fixing device 20 disposed downstream from the secondary transfer bias roller 18 in a recording medium conveyance direction fixes the color toner image on the recording medium P.

Figure 2:
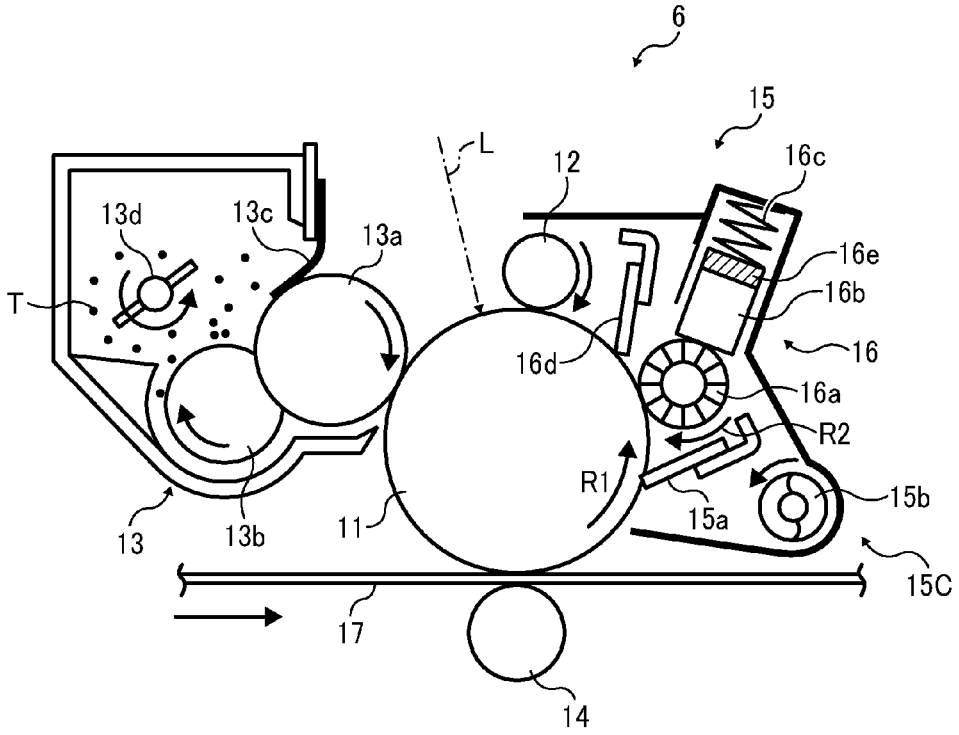
FIG. 2 is a vertical sectional view of an image forming device incorporated in the image forming apparatus shown in FIG. 1.

With reference to FIGS. 1 and 2, a description is provided of an image forming operation performed by the image forming apparatus 1 described above to form a color toner image on a recording medium P.

FIG. 2 is a vertical sectional view of the process cartridge 15 for explaining image forming processes performed on the photoconductive drums 11Y, 11M, 11C, and 11K depicted in FIG. 1. A photoconductive drum 11 depicted in FIG. 2 represents the respective photoconductive drums 11Y, 11M, 11C, and 11K depicted in FIG. 1.

As shown in FIG. 1, conveyance rollers of the ADF 3 feed an original D placed on an original tray onto an exposure glass 5 of the reader 4. The reader 4 optically reads an image on the original D through the exposure glass 5. For example, a lamp of the reader 4 emits light onto the image on the original D through the exposure glass 5 such that the light scans the image on the original D. The light reflected by the original D travels through a plurality of mirrors and a lens into a color sensor that forms an image. The color sensor reads the image into image data corresponding to separation colors, that is, red, green, and blue, which is converted into electric signals. Further, based on the electric signals corresponding to red, green, and blue, an image processor performs processing such as color conversion processing, color correction processing, and space frequency correction processing, thus producing yellow, magenta, cyan, and black image data.

The yellow, magenta, cyan, and black image data created by the reader 4 is sent to the writer 2. The writer 2 emits a laser beam L depicted in FIG. 2 onto the respective photoconductive drums 11Y, 11M, 11C, and 11K according to the yellow, magenta, cyan, and black image data produced by the reader 4.

A detailed description is now given of a charging process, an exposure process, a development process, a primary transfer process, and a cleaning process performed on the photoconductive drums 11Y, 11M, 11C, and 11K shown as the photoconductive drum 11 in FIG. 2.

The photoconductive drum 11 rotates counterclockwise in FIG. 2 in a rotation direction R1. In the charging process, the charging roller 12 disposed opposite the photoconductive drum 11 uniformly charges an outer circumferential surface of the photoconductive drum 11. Thus, the photoconductive drum 11 bears a charging potential. In the exposure process, as the charged outer circumferential surface of the photoconductive drum 11 reaches an irradiation position where the writer 2 depicted in FIG. 1 is disposed opposite the photoconductive drum 11, a light source of the writer 2 emits a laser beam L onto the charged outer circumferential surface of the photoconductive drum 11 according to an electric signal corresponding to the image data in corresponding color. That is, the four light sources of the writer 2 emit laser beams L onto the four photoconductive drums 11Y, 11M, 11C, and 11K, respectively. The laser beams L travel through different optical paths that lead to the photoconductive drums 11Y, 11M, 11C, and 11K according to the yellow, magenta, cyan, and black image data, respectively.

As shown in FIG. 1, the writer 2 emits a laser beam L onto the outer circumferential surface of the leftmost photoconductive drum 11Y according to the yellow image data. For example, a polygon mirror rotating at high speed directs the laser beam L to scan the photoconductive drum 11Y in a main scanning direction parallel to an axial direction of the photoconductive drum 11Y. Thus, an electrostatic latent image corresponding to the yellow image data is formed on the outer circumferential surface of the photoconductive drum 11Y charged by the charging roller 12.

Similarly, the writer 2 emits a laser beam L onto the outer circumferential surface of the second photoconductive drum 11M from the left in FIG. 1 according to the magenta image data, thus forming an electrostatic latent image corresponding to the magenta image data on the photoconductive drum 11M. The writer 2 emits a laser beam L onto the outer circumferential surface of the third photoconductive drum 11C from the left in FIG. 1 according to the cyan image data, thus forming an electrostatic latent image corresponding to the cyan image data on the photoconductive drum 11C. The writer 2 emits a laser beam L onto the outer circumferential surface of the rightmost photoconductive drum 11K in FIG. 1 according to the black image data, thus forming an electrostatic latent image corresponding to the black image data on the photoconductive drum 11K.

As shown in FIG. 2, in the development process, as the electrostatic latent image formed on the photoconductive drum 11 reaches a development position where the development device 13 is disposed opposite the photoconductive drum 11, the development device 13 supplies toner to the electrostatic latent image formed on the photoconductive drum 11, thus developing the electrostatic latent image into a toner image. For example, as shown in FIG. 1, the four development devices 13 supply yellow, magenta, cyan, and black toners to the electrostatic latent images formed on the photoconductive drums 11Y, 11M, 11C, and 11K, thus developing the electrostatic latent images into yellow, magenta, cyan, and black toner images, respectively.

Thereafter, the yellow, magenta, cyan, and black toner images formed on the photoconductive drums 11Y, 11M, 11C, and 11K reach a primary transfer position where the primary transfer bias rollers 14 in contact with an inner circumferential surface of the intermediate transfer belt 17 are disposed opposite the photoconductive drums 11Y, 11M, 11C, and 11K via the intermediate transfer belt 17, respectively. In the primary transfer process, the primary transfer bias rollers 14 primarily transfer the yellow, magenta, cyan, and black toner images formed on the photoconductive drums 11Y, 11M, 11C, and 11K onto an outer circumferential surface of the intermediate transfer belt 17 such that the yellow, magenta, cyan, and black toner images are superimposed on a same position on the intermediate transfer belt 17 successively, thus forming a color toner image on the intermediate transfer belt 17.

As shown in FIG. 2, after the primary transfer process, the outer circumferential surface of the photoconductive drum 11 reaches a cleaning position where a cleaning blade 15*a* of a cleaner 15C is disposed opposite the photoconductive drum 11. In the cleaning process, the cleaning blade 15*a* removes residual toner failed to be transferred onto the intermediate transfer belt 17 and therefore remaining on the photoconductive drum 11 therefrom.

Thereafter, as the outer circumferential surface of the photoconductive drum 11 passes through a lubrication position where a lubricant supplier 16 is disposed opposite the photoconductive drum 11, the lubricant supplier 16 supplies a lubricant to the outer circumferential surface of the photoconductive drum 11. Then, as the outer circumferential surface of the photoconductive drum 11 passes through a discharging position where a discharger is disposed opposite the photoconductive drum 11, the discharger discharges the outer circumferential surface of the photoconductive drum 11. Thus, a series of image forming processes performed on the photoconductive drum 11 is completed.

On the other hand, as shown in FIG. 1, as the intermediate transfer belt 17 bearing the color toner image rotates clockwise, the intermediate transfer belt 17 reaches a secondary transfer position where the secondary transfer bias roller 18 is disposed opposite the intermediate transfer belt 17. At the secondary transfer position, the secondary transfer bias roller 18 secondarily transfers the color toner image formed on the intermediate transfer belt 17 onto a recording medium P conveyed from one of the paper trays 7 in a secondary transfer process.

At a cleaning position where the intermediate transfer belt cleaner 19 is disposed opposite the intermediate transfer belt 17, the intermediate transfer belt cleaner 19 removes residual toner failed to be transferred onto the recording medium P and therefore remaining on the intermediate transfer belt 17 therefrom. The removed toner is collected into the intermediate transfer belt cleaner 19. Thus, a series of transfer processes, that is, the primary transfer process and the secondary transfer process, performed on the intermediate transfer belt 17 is completed.

The recording medium P is conveyed from one of the paper trays 7 to a secondary transfer nip formed between the intermediate transfer belt 17 and the secondary transfer bias roller 18 through the registration roller pair 9. For example, an uppermost recording medium P of a plurality of recording media P loaded on one of the paper trays 7 is picked up and conveyed by the feed roller 8 through a conveyance guide to the registration roller pair 9. The registration roller pair 9 conveys the recording medium P to the secondary transfer nip at a time when the color toner image formed on the intermediate transfer belt 17 reaches the secondary transfer nip.

The recording medium P bearing the color toner image is guided by a conveyance belt to the fixing device 20. The fixing device 20 includes a fixing belt and a pressing roller pressed against the fixing belt to form a fixing nip therebetween where the color toner image is fixed on the recording medium P. Thereafter, the recording medium P bearing the fixed color toner image is discharged by an output roller pair onto an outside of the image forming apparatus 1. Thus, a series of image forming processes performed by the image forming apparatus 1 is completed.

With reference to FIG. 2, a description is provided of a construction of an image forming device 6 incorporated in the image forming apparatus 1 described above.

As shown in FIG. 2, the image forming device 6 includes the photoconductive drum 11 serving as an image carrier; the charging roller 12 serving as a charger that charges the photoconductive drum 11; the development device 13 that visualizes an electrostatic latent image formed on the photoconductive drum 11 into a toner image; the cleaning blade 15*a* that collects the residual toner remaining on the photoconductive drum 11 therefrom; and the lubricant supplier 16 that supplies a lubricant to the photoconductive drum 11.

According to this example embodiment, the image forming device 6 includes the process cartridge 15 formed in a detachable unit detachably attachable to the image forming apparatus 1 and accommodating the photoconductive drum 11, the charging roller 12, the cleaner 15C, and the lubricant supplier 16. The development device 13 is formed in another detachable unit separated from the process cartridge 15 and detachably attachable to the image forming apparatus 1.

The image forming apparatus 1 includes the four image forming devices 6 that form yellow, magenta, cyan, and black toner images and include the four process cartridges 15, respectively. However, since the four image forming devices 6 and the four process cartridges 15 incorporated therein have substantially an identical structure, the suffixes Y, M, C, and K are not assigned to the image forming device 6, the process cartridge 15, and the photoconductive drum 11 shown in FIGS. 2 to 6.

Figure 3:
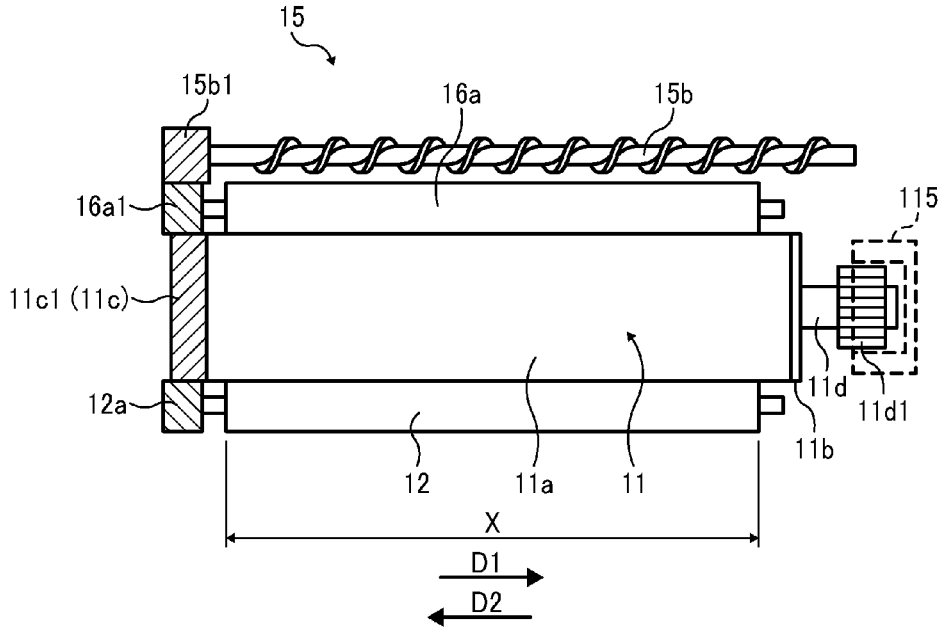
FIG. 3 is a side view of a process cartridge incorporated in the image forming device shown in FIG. 2.
Figure 4:
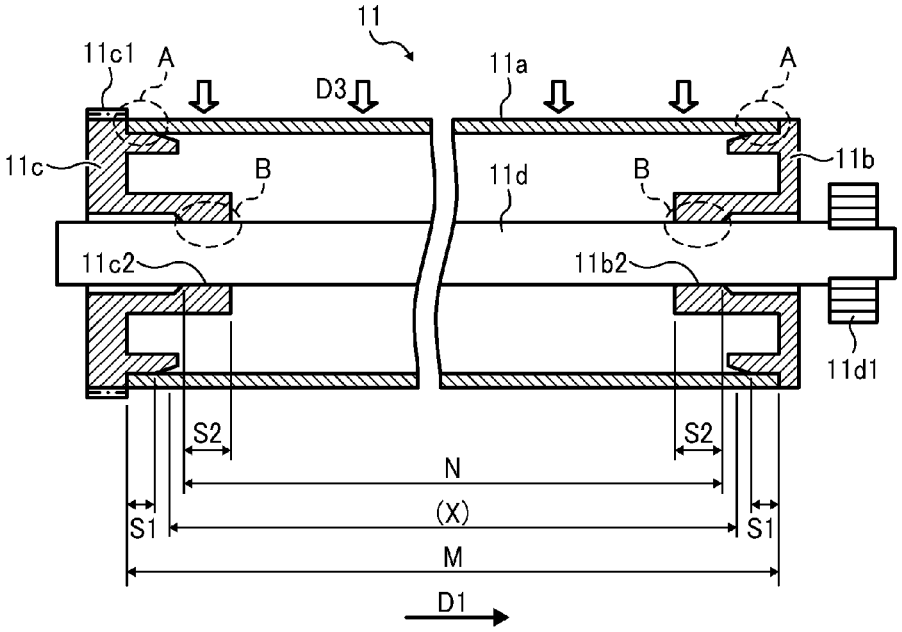
FIG. 4 is a sectional side view of a photoconductive drum according to a first example embodiment incorporated in the process cartridge shown in FIG. 3.

With reference to FIGS. 3 and 4, a detailed description is now given of a construction of the photoconductive drum 11.

FIG. 3 is a side view of the process cartridge 15. FIG. 4 is a sectional side view of the photoconductive drum 11. As shown in FIG. 4, the photoconductive drum 11 is a negatively charged, organic photoconductor or photoreceptor. The photoconductive drum 11 includes a drum body 11*a* serving as an image carrier body constructed of a drum-shaped conductive support layer and a photosensitive layer mounted thereon.

For example, the drum body 11*a* of the photoconductive drum 11 is constructed of the conductive support layer serving as a base layer; an insulating layer serving as an underlying layer; the photosensitive layer serving as a charge generation layer or a charge transport layer; and a protective layer serving as a surface layer, which are layered in this order. The conductive support layer is made of a conductive material having a volume resistivity not greater than about $10^{10}$ Ω·cm.

Two flanges, that is, a first flange 11*b* and a second flange 11*c*, are inserted into the tubular drum body 11*a* by press fit at both lateral ends of the drum body 11*a* in an axial direction thereof, respectively. Alternatively, the first flange 11*b* and the second flange 11*c* may be attached to both lateral ends of the drum body 11*a* in the axial direction thereof, respectively. A shaft 11*d* is situated inside the hollow drum body 11*a*, a detailed description of which is deferred with reference to FIG. 4.

A detailed description is now given of a construction of the charging roller 12.

As shown in FIG. 2, the charging roller 12 is a roller constructed of a conductive metal core constituting a shaft and an elastic layer having a medium resistance and coating an outer circumferential surface of the conductive metal core. The charging roller 12 is situated downstream from the lubricant supplier 16 in the rotation direction R1 of the photoconductive drum 11 and in contact with the photoconductive drum 11. As a power supply incorporated in the image forming apparatus 1 applies a charging bias of a given voltage to the charging roller 12, the charging roller 12 uniformly charges the outer circumferential surface of the photoconductive drum 11 disposed opposite the charging roller 12.

According to this example embodiment, the charging roller 12 contacts the outer circumferential surface of the photoconductive drum 11. Alternatively, the charging roller 12 may be spaced apart from the outer circumferential surface of the photoconductive drum 11 with a slight gap therebetween.

A detailed description is now given of a construction of the development device 13.

As shown in FIG. 2, the development device 13 includes a development roller 13*a* in contact with the photoconductive drum 11 to form a development nip therebetween where the development process is performed. The development device 13 accommodates a one-component developer containing toner T. The development device 13 supplies the toner T to an electrostatic latent image formed on the photoconductive drum 11, developing the electrostatic latent image into a toner image. For example, the development device 13 employing a one-component development method further includes an agitator 13*d* that agitates the toner T; a supply roller 13*b* that supplies the agitated toner T to the development roller 13*a* serving as a developer carrier; and a doctor blade 13*c* that levels the toner T supplied on the development roller 13*a* into a thin layer.

A description is provided of an operation of the development device 13 having the construction described above.

A part of the toner T supplied into the development device 13 is moved onto and carried by the supply roller 13*b*. After the toner T carried by the supply roller 13*b* is charged by friction at a nip formed between the supply roller 13*b* and the development roller 13*a*, it moves onto the development roller 13*a* and is carried by the development roller 13*a*. The toner T carried by the development roller 13*a*, after it is leveled by the doctor blade 13*c* into a thin layer, moves to the development nip formed between the development roller 13*a* and the photoconductive drum 11. At the development nip, the toner T is attracted to an electrostatic latent image formed on the photoconductive drum 11 by a development electric field produced at the development nip.

A detailed description is now given of a configuration of the cleaning blade 15*a*.

The cleaning blade 15*a* is situated upstream from the lubricant supplier 16 in the rotation direction R1 of the photoconductive drum 11. The cleaning blade 15*a* is made of rubber such as urethane rubber and in contact with the outer circumferential surface of the photoconductive drum 11 with a given angle and a given pressure. Thus, the cleaning blade 15*a* mechanically scrapes an adhesive substance adhered to the photoconductive drum 11 such as residual toner off the photoconductive drum 11 into an inside of the process cartridge 15. The collected toner T is conveyed by a conveyance screw 15*b* to a waste toner container as waste toner. Adhesive substances that may adhere to the photoconductive drum 11 may be residual toner failed to be transferred onto the intermediate transfer belt 17, paper dust produced from the recording medium P, a corona product produced on the photoconductive drum 11 as the charging roller 12 performs electric discharge, an additive added to toner, and the like.

A detailed description is now given of a construction of the lubricant supplier 16.

The lubricant supplier 16 includes a solid lubricant 16*b*; a lubricant application roller 16*a* (e.g., a brush roller) to slide over the solid lubricant 16*b* and the photoconductive drum 11; a mount 16*e* mounting the solid lubricant 16*b*; a compression spring 16*c* serving as a biasing member to bias the mount 16*e* and the solid lubricant 16*b* against the lubricant application roller 16*a*; a level blade 16*d* to level the lubricant supplied by the lubricant application roller 16*a* onto the photoconductive drum 11. Thus, the lubricant supplier 16 supplies the lubricant onto the photoconductive drum 11.

The lubricant application roller 16*a* is a brush roller constructed of a metal core and bristles implanted on a base cloth helically wound around the metal core. The bristles have a length in a range of from about 0.2 mm to about 20.0 mm, preferably in a range of from about 0.5 mm to about 10.0 min. If the length of the bristles exceeds about 20.0 mm, as the bristles slide over the photoconductive drum 11 repeatedly over time, the bristles may be directed in a particular direction. Accordingly, the lubricant application roller 16*a* may not scrape the solid lubricant 16*b* and remove the residual toner T from the photoconductive drum 11 precisely. Conversely, if the length of the bristles is smaller than about 0.2 mm, the lubricant application roller 16*a* may physically contact the solid lubricant 16*b* and the photoconductive drum 11 insufficiently. Hence, it is preferable that the length of the bristles is in the above-described range.

The lubricant application roller 16*a* rotates clockwise in FIG. 2 in a rotation direction R2 counter to the rotation direction R1 of the photoconductive drum 11 such that the lubricant application roller 16*a* comes into contact with the photoconductive drum 11 in a forward direction at a contact position where the lubricant application roller 16*a* contacts the photoconductive drum 11. Since the bristles of the lubricant application roller 16*a* are configured to slide over the solid lubricant 16*b* and the photoconductive drum 11, as the lubricant application roller 16*a* rotates in the rotation direction R2, the lubricant application roller 16*a* scrapes the lubricant off the solid lubricant 16*b*. Thereafter, when the lubricant application roller 16*a* conveys the scraped lubricant to the contact position where the lubricant application roller 16*a* contacts the photoconductive drum 11, the lubricant application roller 16*a* applies the lubricant to the photoconductive drum 11.

Disposed opposite the solid lubricant 16*b* via the mount 16*e* is the compression spring 16*c* serving as a biasing member that presses the solid lubricant 16*b* against the lubricant application roller 16*a* evenly. The compression spring 16*c* biases the solid lubricant 16*b* mounted on or attached to the mount 16*e* against the lubricant application roller 16*a*.

The solid lubricant 16*b* is made of zinc stearate as a principal material. For example, the solid lubricant 16*b* is prepared by dissolving a lubricating oil additive containing zinc stearate as a principal material. It is preferable to use zinc stearate that produces no side effect even if it is applied to the photoconductive drum 11 excessively and lubricates the photoconductive drum 11 sufficiently.

The zinc stearate may be typical lamella crystalline powder. Lamella crystal has a self-assembled layer structure produced with amphipathic molecule. Accordingly, as the lamella crystal receives a shear force, it may be broken along an interlayer and subject to slippage. Consequently, the lamella crystal applied on the outer circumferential surface of the photoconductive drum 11 decreases friction between the photoconductive drum 11 and an abutment member or a substance sliding thereover. Since the lamella crystal, upon receiving a shear force, spreads over and coats the outer circumferential surface of the photoconductive drum 11 evenly, the lubricant containing the lamella crystal, even with a small amount thereof, coats the outer circumferential surface of the photoconductive drum 11 effectively.

Other than zinc stearate, the solid lubricant 16*b* may contain a sterarate group such as barium stearate, iron stearate, nickel stearate, cobalt stearate, copper stearate, strontium stearate, and calcium stearate. Alternatively, the solid lubricant 16*b* may contain a similar aliphatic acid group such as zinc oleate, barium oleate, and lead oleate, a stearate compound with those, zinc palmitate, barium palmitate, lead palmitate, and a stearate compound with those. Yet alternatively, the solid lubricant 16*b* may contain an aliphatic acid group such as caprylic acid and linolenic acid. Further, the solid lubricant 16*b* may contain wax such as candelilla wax, carnauba wax, rice wax, Japan wax, perilla oil, bees wax, and lanolin. Those materials are produced into an organic solid lubricant that has an affinity for toner.

The level blade 16*d* is disposed downstream from the lubricant application roller 16*a* in the rotation direction R1 of the photoconductive drum 11. The level blade 16*d* is made of rubber such as urethane rubber and in contact with the outer circumferential surface of the photoconductive drum 11 with a given angle and a given pressure.

As the lubricant application roller 16*a* applies the solid lubricant 16*b* to the outer circumferential surface of the photoconductive drum 11, lubricant powder is carried by the photoconductive drum 11, which lubricates the outer circumferential surface of the photoconductive drum 11 insufficiently. To address this circumstance, the level blade 16*d* levels the lubricant powder into a thin lubricant layer that coats and lubricates the photoconductive drum 11 sufficiently. If the lubricant powder is applied by the lubricant application roller 16*a* onto the photoconductive drum 11 as a fine powder, the level blade 16*d* causes the lubricant powder to coat the photoconductive drum 11 in a form of a molecular film.

As shown in FIG. 2, according to this example embodiment, the lubricant application roller 16*a* rotates in the rotation direction R2 such that the lubricant application roller 16*a* comes into contact with the photoconductive drum 11 in the forward direction at the contact position where the lubricant application roller 16*a* contacts the photoconductive drum 11. Alternatively, the lubricant application roller 16*a* may rotate in a rotation direction counter to the rotation direction R2 such that the lubricant application roller 16*a* comes into contact with the photoconductive drum 11 in the counter direction at the contact position.

A description is provided of attachment of the process cartridge 15 and driving of the charging roller 12, the lubricant application roller 16*a*, and the conveyance screw 15*b*.

As described above, the process cartridge 15 is detachably attached to the image forming apparatus 1. For example, while a front cover of the image forming apparatus 1 is opened, each process cartridge 15 is inserted into the image forming apparatus 1 horizontally in a front-to-rear direction D1 depicted in FIG. 3 and removed from the image forming apparatus 1 horizontally in a rear-to-front direction D2.

As shown in FIG. 3, as the process cartridge 15 incorporating the photoconductive drum 11 is attached to the image forming apparatus 1, a driven coupling 11*d*1 is mounted on one end, that is, a rear end in the front-to-rear direction D1, of the shaft 11*d* of the photoconductive drum 11 in an axial direction thereof. The driven coupling 11*d*1 engages a driving coupling 115 mounted on a side plate of the image forming apparatus 1 and connected to a motor shaft of a driving motor located in the image forming apparatus 1.

While the driven coupling 11*d*1 engages the driving coupling 115, as a driving force generated by the driving motor is transmitted to the photoconductive drum 11 through the driving coupling 115 and the driven coupling 11*d*1, the photoconductive drum 11 rotates counterclockwise in FIG. 2 in the rotation direction R1. The driving force is further transmitted from the photoconductive drum 11 to the plurality of driven rotary bodies, that is, the charging roller 12, the conveyance screw 15*b*, and the lubricant application roller 16*a*, thus driving and rotating the charging roller 12 and the lubricant application roller 16*a* clockwise in FIG. 2 and driving and rotating the conveyance screw 15*b* counterclockwise in FIG. 2.

As shown in FIG. 4, a drum gear 11*c*1 is attached to another end of the photoconductive drum 11 in the axial direction thereof, that is, a front end of the photoconductive drum 11 in the front-to-rear direction D1. For example, the second flange 11*c* mounting the drum gear 11*c*1 on an outer circumferential surface thereof is inserted by press fit into the front end of the tubular drum body 11*a* incorporating the photosensitive layer. The first flange 11*b* is inserted by press fit into the rear end of the drum body 11*a*.

As shown in FIG. 3, a charging roller gear 12*a* engaging the drum gear 11*c*1 attached to the photoconductive drum 11 is mounted on a front end of a shaft of the charging roller 12. A lubricant application roller gear 16*a*1 engaging the drum gear 11*c*1 attached to the photoconductive drum 11 is mounted on a front end of a shaft of the lubricant application roller 16*a*. A conveyance screw gear 15*b*1 engaging the lubricant application roller gear 16*a*1 is mounted on a front end of a shaft of the conveyance screw 15*b*.

As a driving force generated by the driving motor located inside the image forming apparatus 1 is transmitted to the photoconductive drum 11 through the driving coupling 115 and the driven coupling 11*d*1, the driving force is further transmitted from the photoconductive drum 11 to the charging roller 12 through the drum gear 11*c*1 and the charging roller gear 12*a*. Also, the driving force is further transmitted from the photoconductive drum 11 to the lubricant application roller 16*a* through the drum gear 11*c*1 and the lubricant application roller gear 16*a*1. Additionally, the driving force is further transmitted from the photoconductive drum 11 to the conveyance screw 15*b* through the lubricant application roller gear 16*a*1 and the conveyance screw gear 15*b*1. Thus, the plurality of driven rotary bodies, that is, the charging roller 12, the lubricant application roller 16*a*, and the conveyance screw 15*b*, is driven and rotated. For example, as shown in FIG. 2, the charging roller 12 and the lubricant application roller 16*a* are rotated clockwise and the conveyance screw 15*b* is rotated counterclockwise.

With reference to FIG. 4, a detailed description is now given of a configuration of the photoconductive drum 11.

The photoconductive drum 11 serving as an image carrier includes the drum body 11*a* serving as an image carrier body, the first flange 11*b*, the second flange 11*c*, and the shaft 11*d*.

As described above, the tubular drum body 11*a* includes the conductive support layer and the photosensitive layer coating the conductive support layer. A toner image is formed on an outer circumferential surface of the drum body 11*a* through the image forming processes described above. The drum body 11*a* has an outer diameter of about 30 mm.

The first flange 11*b* engages the drum body 11*a* at a rear, first engagement portion A of the first flange 11*b* in contact with one end of the drum body 11*a* in the axial direction of the photoconductive drum 11, that is, the rear end of the drum body 11*a*. For example, the first flange 11*b* is inserted by press fit into the drum body 11*a* at the rear, first engagement portion A of the first flange 11*b*. Similarly, the second flange 11*c* engages the drum body 11*a* at a front, first engagement portion A of the second flange 11*c* in contact with another end of the drum body 11*a* in the axial direction of the photoconductive drum 11, that is, the front end of the drum body 11*a*. For example, the second flange 11*c* is inserted by press fit into the drum body 11*a* at the front, first engagement portion A of the second flange 11*c*. A through-hole 11*b*2 having a diameter of about 12 mm is produced at a position corresponding to a rotation axis of the drum body 11*a* or the photoconductive drum 11. Similarly, a through-hole 11*c*2 having a diameter of about 12 mm is produced at a position corresponding to the rotation axis of the drum body 11*a* or the photoconductive drum 11. The first flange 11*b* and the second flange 11*c* are made of resin.

The shaft 11*d* penetrating the drum body 11*a* and extending in the axial direction of the photoconductive drum 11 bridges at least the first flange 11*b* and the second flange 11*c*. The shaft 11*d* engages or is inserted by press fit into the through-hole 11*b*2 of the first flange 11*b* at a rear, second engagement portion B, that is, a part of the through-hole 11*b*2. Similarly, the shaft 11*d* engages or is inserted by press fit into the through-hole 11*c*2 of the second flange 11*c* at a front, second engagement portion B, that is, a part of the through-hole 11*c*2. Alternatively, the second engagement portion B may span throughout the entire inner surface of the through-holes 11*b*2 and 11*c*2.

The shaft 11*d* is made of metal such as SUM special steel and has an outer diameter of about 12 mm. The diameter of the through-hole 11*b*2 of the first flange 11*b* and the through-hole 11*c*2 of the second flange 11*e* at the second engagement portion B is slightly smaller than the outer diameter of the shaft 11*d*. The diameter of the through-holes 11*b*2 and 11*c*2 at portions other than the second engagement portion B is sufficiently greater than the outer diameter of the shaft 11*d*.

The second engagement portion B of the first flange 11*b* and the second flange 11*c* that engages the shaft 11*d* is situated inboard from the first engagement portion A of the first flange 11*b* and the second flange 11*c* that engages the drum body 11*a* in the axial direction of the photoconductive drum 11. Hence, an axial interval N defined by the second engagement portion B of the first flange 11*b* and the second engagement portion B of the second flange 11*c* in the axial direction of the photoconductive drum 11 is smaller than an axial interval M defined by the first engagement portion A of the first flange 11*b* and the first engagement portion A of the second flange 11*c* in the axial direction of the photoconductive drum 11.

Accordingly, even if the photoconductive drum 11 receives a substantial force from an abutment member that abuts the outer circumferential surface of the photoconductive drum 11 or the photoconductive drum 11 accidentally receives an external force while the photoconductive drum 11 is transported without being secured inside the process cartridge 15 or the image forming apparatus 1, the photoconductive drum 11 is not bent or deformed. According to this example embodiment, the abutment member may include the charging roller 12, the level blade 16*d*, the lubricant application roller 16*a*, the cleaning blade 15*a*, and the development roller 13*a* depicted in FIG. 2.

For example, as shown in FIG. 4, if the photoconductive drum 11 receives a force exerted in a direction D3 from the abutment member, the first engagement portion A of the first flange 11*b* and the second flange 11*e* receives the force which in turn is received by the shaft 11*d* contacting the second engagement portion B of the first flange 11*b* and the second flange 11*e*. The axial interval N defined by both second engagement portions B in the axial direction of the drum body 11*a* is smaller than the axial interval M defined by both first engagement portions A in the axial direction of the drum body 11*a*. Since the shaft 11*d* receives a force exerted in the direction D3 from the abutment member at the two second engagement portions B of the first flange 11*b* and the second flange 11*c* aligned in the axial direction of the drum body 11*a* with the smaller axial interval N therebetween, the shaft 11*d* attains an enhanced mechanical strength or an enhanced durability against bending and deformation compared to a comparative photoconductive drum 211 shown in FIG. 5. Accordingly, the shaft 11*d* enhances the mechanical strength or the durability of the photoconductive drum 11 against bending and deformation.

Figure 5:
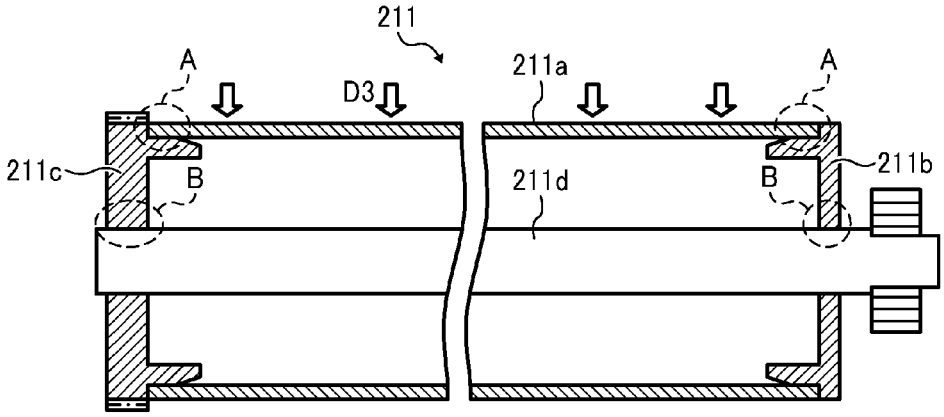
FIG. 5 is a sectional side view of a comparative photoconductive drum.

FIG. 5 is a sectional side view of the comparative photoconductive drum 211. The comparative photoconductive drum 211 includes a drum body 211*a*; a first flange 211*b* and a second flange 211*c* attached to the drum body 211*a*; and a shaft 211*d* mounting the first flange 211*b* and the second flange 211*c*. Similar to the drum body 11*a* depicted in FIG. 4, the drum body 211*a* engages the first flange 211*b* and the second flange 211*c* at the first engagement portions A, respectively. However, unlike the shaft 11*d* depicted in FIG. 4, the shaft 211*d* engages the first flange 211*b* and the second flange 211*c* at the second engagement portions B that overlap the first engagement portions A in a direction perpendicular to an axial direction of the drum body 211*a*. That is, the first engagement portion A of the first flange 211*b* and the second flange 211*c* that engages each lateral end of the drum body 211*a* in the axial direction thereof and the second engagement portion B of the first flange 211*b* and the second flange 211*c* are aligned in the direction perpendicular to the axial direction of the drum body 211*a*. Accordingly, the shaft 211*d* receives a force exerted in the direction D3 from the abutment member that abuts the photoconductive drum 211 in an axial interval on the shaft 211*d* in the axial direction of the drum body 211*a* that is greater than the axial interval N depicted in FIG. 4. Consequently, the shaft 211*d* is susceptible to bending and deformation.

To address this circumstance of the comparative photoconductive drum 211, according to this example embodiment shown in FIG. 4, the second engagement portion B of the first flange 11*b* and the second flange 11*c* that engages the shaft 11*d* is disposed inboard from a lateral edge of the abutment member for abutting the outer circumferential surface of the photoconductive drum 11 (e.g., the charging roller 12, the development roller 13*a*, the cleaning blade 15*a*, the lubricant application roller 16*a*, and the level blade 16*d* depicted in FIG. 2) in the axial direction of the photoconductive drum 11. As shown in FIG. 4, the axial interval N defined by the two second engagement portions B is smaller than an axial span X on the photoconductive drum 11 where the abutment member (e.g., the lubricant application roller 16*a* and the charging roller 12 depicted in FIG. 3) comes into contact with the photoconductive drum 11. Accordingly, the mechanical strength or the durability of the shaft 11*d* against a force exerted by the abutment member is improved precisely, preventing bending and deformation of the shaft 11*d*.

As shown in FIG. 4, an axial length S2 of the second engagement portion B is greater than an axial length S1 of the first engagement portion A in the axial direction of the photoconductive drum 11. A circumferential length of the second engagement portion B is greater than a circumferential length of the first engagement portion A. It is to be noted that the axial length defines a length of an engagement portion where two members engage each other in an axial direction thereof. The circumferential length defines a length of an engagement portion where two members engage each other in a circumferential direction thereof.

In order to increase the mechanical strength with which the drum body 11*a* engages the first flange 11*b* and the second flange 11*c*, it is preferable to increase the axial length S1 and the circumferential length of the first engagement portion A of the first flange 11*b* and the second flange 11*c* that engages the drum body 11*a*. However, the increased axial length S1 and the increased circumferential length of the first engagement portion A may deform the thin, tubular drum body 11*a* during assembly. Conversely, engagement between the shaft 11*d* and the first flange 11*b* and between the shaft 11*d* and the second flange 11*c* is imposed with a restriction smaller than that imposed on engagement between the drum body 11*a* and the first flange 11*b* and between the drum body 11*a* and the second flange 11*c*, allowing the axial length S2 and the circumferential length of the second engagement portion B to be relatively greater as long as they do not complicate engagement processes. Accordingly, the axial length S2 and the circumferential length of the second engagement portion B greater than the axial length S1 and the circumferential length of the first engagement portion A, even if the first flange 11*b* and the second flange 11*c* engage the drum body 11*a* and the shaft 11*d*, prevent deformation of the drum body 11*a* and improve the strength with which the first flange 11*b* and the second flange 11*c* engage the drum body 11*a* and the shaft 11*d*.

According to the example embodiment shown in FIG. 4, each of the first flange 11*b* and the second flange 11*c* engages the shaft 11*d* at the single, second engagement portion B.

Figure 6:
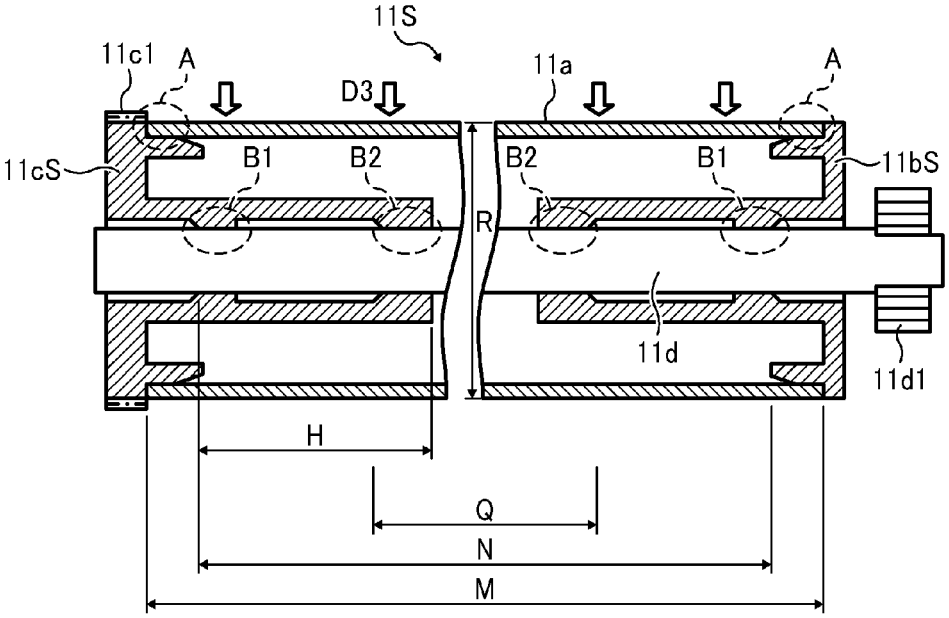
FIG. 6 is a sectional side view of a photoconductive drum according to a second example embodiment.

Alternatively, each of the first flange 11*b* and the second flange 11*c* may engage the shaft 11*d* at a plurality of second engagement portions B1 and B2 spaced apart from each other in the axial direction of the photoconductive drum 11, as shown in FIG. 6. FIG. 6 is a sectional side view of a photoconductive drum 11S incorporating a first flange 11*b*S and a second flange 11*c*S that have the plurality of second engagement portions B1 and B2. As shown in FIG. 6, each of the first flange 11*b*S and the second flange 11*c*S has the two second engagement portions B1 and B2. Similar to the first engagement portions A defining the axial interval M and the second engagement portions B defining the axial interval N of the photoconductive drum 11 depicted in FIG. 4, the outboard, second engagement portions B1 situated outboard from the inboard, second engagement portions B2 in an axial direction of the photoconductive drum 11S define the axial interval N that is smaller than the axial interval M defined by the first engagement portions A. Further, the inboard, second engagement portions B2 define an axial interval Q that is smaller than the axial interval N defined by the outboard, second engagement portions B1.

The axial interval N defined by the outboard, second engagement portions B1 in the axial direction of the photoconductive drum 11S is smaller than the axial interval M defined by the first engagement portions A in the axial direction of the photoconductive drum 11S. Since the shaft 11*d* receives a force exerted in the direction D3 from the abutment member at the four second engagement portions B1 and B2 aligned in the axial direction of the photoconductive drum 11S within the smaller axial interval N between the outboard, second engagement portions B1, the shaft 11*d* attains an increased mechanical strength or an increased durability against bending and deformation compared to the photoconductive drum 11 shown in FIG. 4. Accordingly, the shaft 11*d* enhances the mechanical strength or the durability of the photoconductive drum 11S against bending and deformation.

As shown in FIG. 6, an axial interval H is defined by an outboard edge of the outboard, second engagement portion B1 and an inboard edge of the inboard, second engagement portion B2, serving as a supplemental engagement portion, in the axial direction of the photoconductive drum 11S. The axial interval H is equivalent to an outer diameter R of the drum body 11*a* of the photoconductive drum 11S.

If the axial interval H is excessively smaller than the outer diameter R of the drum body 11*a*, the number of points of application where the abutment member exerts a force to the first flange 11$b$S and the second flange 11$c$S through the drum body 11$a$ increases, obstructing improvement of the mechanical strength or the durability of the shaft 11$d$ against bending and deformation. Conversely, if the axial interval H is excessively greater than the outer diameter R of the drum body 11$a$, the rigidity of the first flange 11$b$S and the second flange 11$c$S decreases. To address those circumstances, according to this example embodiment shown in FIG. 6, the axial interval H defined by the outboard, second engagement portion B1 and the inboard, second engagement portion B2 in the axial direction of the photoconductive drum 11S is equivalent to the outer diameter R of the drum body 11$a$.

Figure 7:
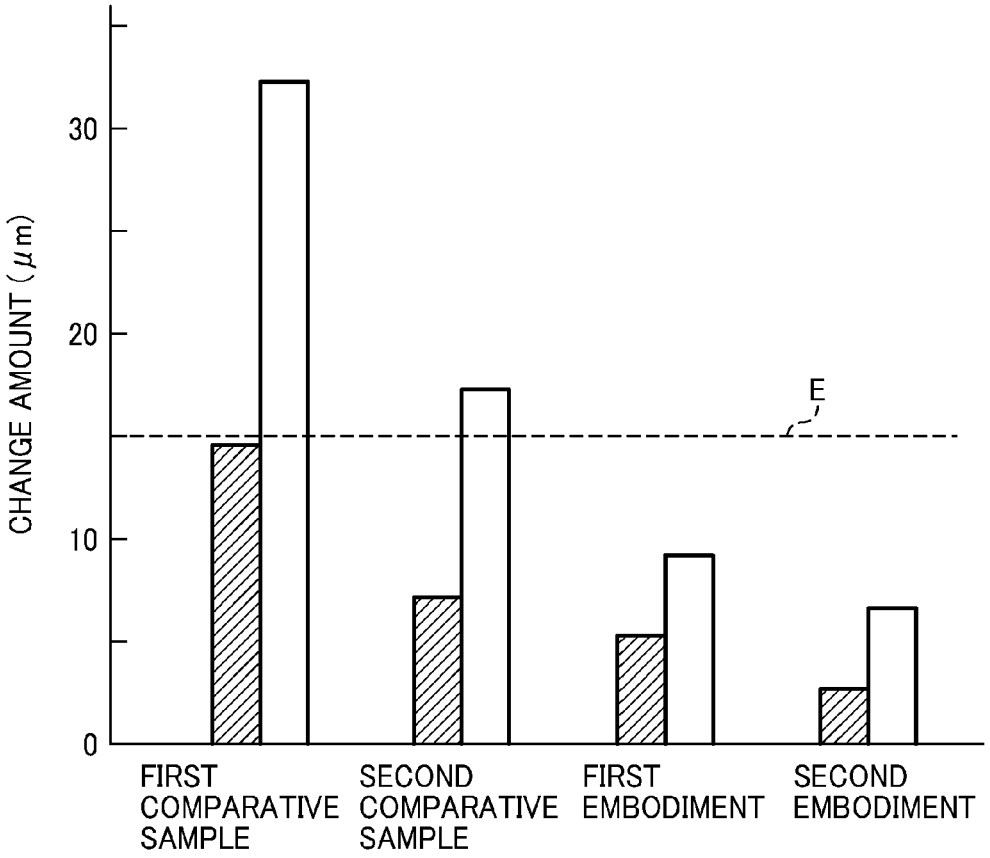
FIG. 7 is a graph showing results of an experiment for examining change of a gap between a charging roller and a photoconductive drum of various samples.

With reference to FIG. 7, a description is provided of results of an experiment to examine advantages of the photoconductive drums 11 and 11S described above.

FIG. 7 is a graph showing an amount of change of a gap between the charging roller 12 and the photoconductive drum (e.g., the photoconductive drum 11, 11S, 211, or a modification of the photoconductive drum 211) at both lateral ends in the axial direction thereof. Eight photoconductive drums, that is, the photoconductive drums 11, 11S, and 211 and a modification of the photoconductive drum 211, each having an outer diameter of 30 mm, were installed in a modified image forming apparatus 1. Change in a gap between the charging roller 12 and each of the photoconductive drums, that is, an amount of bending, at both lateral ends of the photoconductive drum in the axial direction thereof was measured.

In FIG. 7, a first embodiment represents the photoconductive drum 11 shown in FIG. 4. A second embodiment represents the photoconductive drum 1 IS shown in FIG. 6. A first comparative sample represents a modification of the photoconductive drum 211 shown in FIG. 5 in which the shaft 211$d$ is eliminated. A second comparative sample represents the photoconductive drum 211. The shaded bars indicate results obtained with the photoconductive drums having an axial length of about 340 mm that corresponds to an A3 size recording medium. The non-shaded bars indicate results obtained with the photoconductive drums having an axial length of about 374 mm that corresponds to an A3 extension size recording medium. A threshold E of 15 micrometers defines a boundary over which the photoconductive drum is bent substantially, resulting in formation of a faulty toner image on the recording medium P.

Since the shaded and non-shaded bars of the first embodiment and the second embodiment are below the threshold E, the experiment shows that the photoconductive drum 11 depicted in FIG. 4 and the photoconductive drum 11S depicted in FIG. 6 achieve advantages of preventing bending of the photoconductive drums 11 and 11S and therefore forming a high quality toner image on the recording medium P.

A description is provided of advantages of the photoconductive drums 11 and 11S depicted in FIGS. 4 and 6, respectively.

As shown in FIG. 4, the photoconductive drum 11 includes the drum body 11$a$ serving as an image carrier body, the first flange 11$b$, the second flange 11$c$, and the shaft 11$d$. Each of the first flange 11$b$ and the second flange 11$c$ includes the first engagement portion A that engages the drum body 11$a$ and the second engagement portion B that engages the shaft 11$d$. The second engagement portion B is disposed inboard from the first engagement portion A in the axial direction of the photoconductive drum 11, improving the mechanical strength or the durability of the photoconductive drum 11 against bending and deformation.

As shown in FIG. 2, the photoconductive drum 11, the charging roller 12, the cleaner 15C, and the lubricant supplier 16 of the image forming device 6 are formed into the process cartridge 15, downsizing the image forming device 6 and facilitating maintenance of the image forming device 6. Alternatively, the development device 13 may also be formed into the process cartridge 15 or the photoconductive drum 11 may be detachably attached to the image forming apparatus 1 independently. In this case also, the advantages of the photoconductive drums 11 and 11S described above are achieved.

According to the above-described example embodiments, the image forming apparatus 1 is installed with the development device 13 that employs a one-component development method using a one-component developer containing toner particles. Alternatively, the image forming apparatus 1 may be installed with a development device that employs a two-component development method using a two-component developer containing toner particles and carrier particles.

The photoconductive drums 11 and 11S are installed in the tandem color image forming apparatus 1 incorporating the intermediate transfer belt 17. Alternatively, the photoconductive drums 11 and 11S may be installed in a tandem color image forming apparatus incorporating a transfer conveyance belt that carries and conveys a recording medium onto which toner images formed on a plurality of photoconductive drums disposed opposite and aligned along the transfer conveyance belt are directly transferred such that the toner images are superimposed on a same position on the recording medium. Yet alternatively, the photoconductive drums 11 and 11S may be installed in a monochrome image forming apparatus and other image forming apparatuses. Further, as shown in FIG. 1, the photoconductive drums 11Y, 11M, 11C, and 11K are situated above the intermediate transfer belt 17. Alternatively, the photoconductive drums 11Y, 11M, 11C, and 11K may be situated below the intermediate transfer belt 17. In this case, the charging roller 12 is situated below the respective photoconductive drums 11Y, 11M, 11C, and 11K. In this case also, the advantages of the photoconductive drums 11 and 11S described above are achieved.

As shown in FIG. 4, a part of the through-hole 11$b$2 of the first flange 11$b$ constitutes the second engagement portion B. Similarly, a part of the through-hole 11$c$2 of the second flange 11$c$ constitutes the second engagement portion B. The shaft 11$d$ penetrating the drum body 11$a$ through the through-holes 11$b$2 and 11$c$2 engages the second engagement portion B of the first flange 11$b$ and the second flange 11$c$. Alternatively, the entire inner circumferential surface of the respective through-holes 11$b$2 and 11$c$2 may constitute the second engagement portion B that engages the shaft 11$d$. For example, a part of an inner portion of the first flange 11$b$ and the second flange 11$c$, that is, a part of each of the through-holes 11$b$2 and 11$c$2, disposed opposite the shaft 11$d$ and other than the second engagement portion B may be countersunk substantially. In this case also, the advantages of the photoconductive drums 11 and 11S described above are achieved.

It is to be noted that a process cartridge defines a unit detachably attachable to the image forming apparatus 1 and constructed of an image carrier (e.g., the photoconductive drums 11 and 11S) and at least one of a charger (e.g., the charging roller 12) that charges the image carrier, a development device (e.g., the development device 13) that develops an electrostatic latent image formed on the image carrier into a visible image, and a cleaner (e.g., the cleaner 15C) that cleans the image carrier. Engagement defines press fit, attachment, shrink fit, cooling fit, or the like.

A description is provided of advantages of the photoconductive drums 11 and 11S and the image forming apparatus 1 incorporating the photoconductive drum 11 or 11S.

As shown in FIG. 4, the image carrier (e.g., the photoconductive drums 11 and 11S) includes the tubular drum body 11*a* serving as an image carrier body that carries a toner image on the outer circumferential surface thereof; the shaft 11*d* disposed inside the drum body 11*a*; the first flange 11*b* mounted on the shaft 11*d*; and the second flange 11*c* spaced apart from the first flange 11*b* in an axial direction of the image carrier and mounted on the shaft 11*d*. The shaft 11*d* penetrates the drum body 11*a* through the through-hole 11*b*2 of the first flange 11*b* and the through-hole 11*c*2 of the second flange 11*c*. The shaft 11*d* extends in a longitudinal direction, that is, the axial direction, of the image carrier such that the shaft 11*d* bridges at least the first flange 11*b* and the second flange 11*c*. The through-holes 11*b* and 11*c* correspond to a rotation axis of the drum body 11*a*. Each of the first flange 11*b* and the second flange 11*c* includes the first engagement portion A that engages the lateral end of the drum body 11*a* in the axial direction of the image carrier and the second engagement portion B, constituting at least a part of the through-holes 11*b*2 and 11*c*2, which engages the shaft 11*d*. The second engagement portion B is disposed inboard from the first engagement portion A in the axial direction of the image carrier.

Since the second engagement portion B of the first flange 11*b* and the second flange 11*c* that engages the shaft 11*d* is disposed inboard from the first engagement portion A of the first flange 11*b* and the second flange 11*c* that engages the drum body 11*a* in the axial direction of the image carrier, the image carrier achieves an enhanced mechanical strength or an enhanced durability against bending and deformation. Accordingly, the process cartridge 15 and the image forming apparatus 1 incorporating the image carrier also achieve the enhanced mechanical strength or the enhanced durability against bending and deformation.

The present invention has been described above with reference to specific example embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative example embodiments may be combined with each other and/or substituted for each other within the scope of the present invention.

What is claimed is:

1. An image carrier comprising:
- a tubular image carrier body to carry an image on an outer circumferential surface thereof;
- a shaft disposed inside the image carrier body;
- a first flange mounted on the shaft; and
- a second flange spaced apart from the first flange in an axial direction of the image carrier and mounted on the shaft,
- each of the first flange and the second flange including:
- a through-hole contacting the shaft;
- a first engagement portion to engage a lateral end of the image carrier body in the axial direction of the image carrier;
- a second engagement portion, constituting at least a part of the through-hole, to engage the shaft, the second engagement portion being inboard from the first engagement portion in the axial direction of the image carrier; and
- a gap between the shaft and the second engagement portion in the axial direction.

2. The image carrier according to claim 1, wherein the shaft extends in the axial direction of the image carrier and bridges the first flange and the second flange.

3. The image carrier according to claim 2, wherein the shaft penetrates the image carrier body through the through-hole of each of the first flange and the second flange.

4. The image carrier according to claim 3, wherein the through-hole of each of the first flange and the second flange corresponds to a rotation axis of the image carrier body.

5. The image carrier according to claim 1, wherein an entire inner circumferential surface of the through-hole of each of the first flange and the second flange constitutes the second engagement portion that engages the shaft.

6. An image carrier comprising:
- a tubular image carrier body to carry an image on an outer circumferential surface thereof;
- a shaft disposed inside the image carrier body;
- a first flange mounted on the shaft; and
- a second flange spaced apart from the first flange in an axial direction of the image carrier and mounted on the shaft,
- each of the first flange and the second flange including:
  - a through-hole contacting the shaft;
  - a first engagement portion to engage a lateral end of the image carrier body in the axial direction of the image carrier; and
    - a second engagement portion, constituting at least a part of the through-hole, to engage the shaft, the second engagement portion disposed inboard from the first engagement portion in the axial direction of the image carrier;
- wherein each of the first flange and the second flange further includes a supplemental engagement portion spaced apart from the second engagement portion in the axial direction of the image carrier.

7. The image carrier according to claim 6, wherein the supplemental engagement portion is disposed inboard from the second engagement portion in the axial direction of the image carrier.

8. The image carrier according to claim 7, wherein a first axial interval equivalent to an outer diameter of the image carrier body is defined by the second engagement portion and the supplemental engagement portion of each of the first flange and the second flange in the axial direction of the image carrier.

9. The image carrier according to claim 1, wherein the second engagement portion of each of the first flange and the second flange is disposed inboard from a lateral edge of an abutment member for abutting the outer circumferential surface of the image carrier in the axial direction thereof.

10. The image carrier according to claim 1, wherein a circumferential length of the second engagement portion is greater than a circumferential length of the first engagement portion.

11. The image carrier according to claim 1, wherein an axial length of the second engagement portion is greater than an axial length of the first engagement portion in the axial direction of the image carrier.

12. The image carrier according to claim 1, wherein a second axial interval is defined by the first engagement portion of the first flange and the first engagement portion of the second flange in the axial direction of the image carrier and a third axial interval smaller than the second axial interval is defined by the second engagement portion of the first flange and the second engagement portion of the second flange in the axial direction of the image carrier.

13. The image carrier according to claim 12, wherein the third axial interval is smaller than an axial span on the image carrier where an abutment member comes into contact with the outer circumferential surface of the image carrier.

14. The image carrier according to claim 1, wherein the first flange and the second flange are inserted into the tubular image carrier body by press fit.

15. The image carrier according to claim 1, wherein a part of the through-hole of each of the first flange and the second flange other than the second engagement portion is countersunk.

16. A process cartridge detachably attachable to an image forming apparatus, the process cartridge comprising the image carrier according to claim 1.

17. An image forming apparatus comprising the image carrier according to claim 1.

18. A process cartridge detachably attachable to an image forming apparatus, the process cartridge comprising the image carrier according to claim 6.

19. An image forming apparatus comprising the image carrier according to claim 6.

* * * * *